US006517071B2

(12) United States Patent
Gallant

(10) Patent No.: US 6,517,071 B2
(45) Date of Patent: Feb. 11, 2003

(54) JIGSAW PUZZLE

(75) Inventor: Paul Gallant, Montréal (CA)

(73) Assignee: Inventi Limited Partnership, Quebec (CA)

( * ) Notice: Subject to any disclaimer, the term of this patent is extended or adjusted under 35 U.S.C. 154(b) by 0 days.

(21) Appl. No.: 09/948,168

(22) Filed: Sep. 6, 2001

(65) Prior Publication Data

US 2002/0043760 A1 Apr. 18, 2002

(30) Foreign Application Priority Data

Sep. 6, 2000 (CA) ..... 2317788

(51) Int. Cl.[7] ..... A63F 9/10
(52) U.S. Cl. ..... 273/157 R
(58) Field of Search ..... 273/157 R, 153 R, 273/156; 434/406

(56) References Cited

U.S. PATENT DOCUMENTS

| | | | | | |
|---|---|---|---|---|---|
| 3,704,892 | A | * | 12/1972 | Moravick et al. | 273/157 R |
| D231,789 | S | * | 6/1974 | Ozeki | 273/157 R |
| 3,865,382 | A | * | 2/1975 | Myller | 273/157 R |
| D246,544 | S | | 11/1977 | Brinkley | |
| D248,987 | S | | 8/1978 | Paschal | |
| 4,486,018 | A | * | 12/1984 | Keller, Jr. | 273/157 R |
| 4,993,989 | A | | 2/1991 | Gidwani | 446/487 |
| 5,251,900 | A | | 10/1993 | Gallant | 273/157 R |
| 5,299,804 | A | | 4/1994 | Stevens | 273/155 |
| 5,445,380 | A | | 8/1995 | Polsky | 273/155 |
| 5,544,882 | A | * | 8/1996 | Sarkar | 273/157 R |
| 5,791,647 | A | | 8/1998 | Reiling | 273/157 R |
| 5,826,873 | A | | 10/1998 | Lavermicocca | 273/157 R |
| 6,015,150 | A | | 1/2000 | Gigu´´re | 273/157 R |
| 6,024,360 | A | | 2/2000 | Orbach et al. | 273/157 R |
| 6,086,067 | A | | 7/2000 | Benoît et al. | 273/157 R |

* cited by examiner

*Primary Examiner*—Steven Wong
(74) *Attorney, Agent, or Firm*—Merchant & Gould P.C.

(57) ABSTRACT

A two-dimensional jigsaw puzzle including a plurality of pieces, each of the pieces having a main body made of a foam with memory. Each main body has a layer of glue extending thereover and a flexible sheet adhesively bonded thereto. The flexible sheet bears a portion of a picture of the puzzle and the main bodies of the pieces have complementary interlocking joints for detachably assembling the pieces to one another to form the picture of the puzzle. Each of the main bodies has a peripheral side surface with predetermined thickness such that, when the pieces are assembled to one another, the interlocking joints substantially hold the pieces together by friction contact between the peripheral side surfaces of the main bodies. The glue is of a type which remains substantially flexible after setting thereof. As a result of the above-mentioned, the two-dimensional jigsaw puzzle is capable of being bent without any of its pieces detaching themselves from the puzzle.

15 Claims, 5 Drawing Sheets

JIGSAW PUZZLE

FIELD OF THE INVENTION

The present invention relates to a jigsaw puzzle. More particularly, the present invention relates to a two-dimensional jigsaw puzzle.

BACKGROUND OF THE INVENTION

Conventional planar jigsaw puzzles are very well known in the art. These puzzles generally consist of a mass of irregularly shaped pieces of cardboard, plastic or wood that form a picture when fitted together.

A major problem associated with this type of puzzles is that once the puzzle is assembled, it is difficult to transport it because the pieces detach themselves from the puzzle since they do not readily hold together. Very often, a planar board must be used to support the puzzle so that the latter does not fall apart and can thus be transported.

Another problem associated with the above-mentioned type of puzzle is that, when an assembled puzzle is bent concavely or in any other curved manner, the surface of the puzzle becomes staggered and very often its pieces will detach themselves because they are not malleable and thus not capable of following the shape of the curved surface imposed onto the puzzle.

Yet another problem associated with the above-mentioned type of puzzles is that the pieces are very often precariously fitted onto one another such that any movement of the puzzle which is not coplanar to the puzzle, such as shaking of the puzzle or bending thereof for example, will often cause the pieces to detach themselves from the puzzle.

Known in the art, there is U.S. Pat. No. 6,086,067 granted to Benoit et al. in which is described a set of interlocking elements capable of being joined together to form a corner piece of a puzzle game that constitutes a three-dimensional pictorial representation of a structure. In one embodiment, the set of interlocking elements comprises a first element that can be folded into a corner configuration. A second generally planar element interlocks through a dovetail-type joint with the first element to maintain the first elements in a folded, corner-like configuration. The first and the second elements are provided with image-bearing surfaces that constitute individual pictorial entities contributing to a complete representation of the structure. When the first and the second elements are interlocked, the image-bearing surfaces unite visually to provide image continuity over the exposed surface of the corner piece. In a second embodiment, the set of interlocking element includes three discrete planar elements that unite through male/female joints into a T-shaped configuration.

Known in the art, there is also U.S. Pat. No. 5,791,647 granted to Reiling in which is described a multilayer three-dimensional puzzle including two or more planar layers supported by separators in a spaced relationship to one another. Each layer consists of assembled interlocking puzzle pieces. Assembled, spaced apart layers form a scene with a three-dimensional effect. The assembly forms a rigid self-supporting structure that can stand on a horizontal surface or be supported by a single point to hang as a mobile. Each of the puzzle layers can be printed on both sides to increase the assembly challenge and permit viewing from all sides. The three-dimensional effect can be accentuated by providing a slight curve to one or more of the layers or dimensioning the separators to place the planar layers at a small angle to one another.

Known in the art, there is also U.S. Pat. No. 5,251,900 granted to Gallant in which is described a puzzle formed a plurality of puzzle pieces which, when assembled, create a self-standing, three-dimensional building structure. The puzzle pieces are of irregular, polygonal shape, but all puzzle pieces are flat, planar blocks. The blocks are releasably interlocked about a common plane with first, edgewise, complementary dovetail joints. For interlocking puzzle walls that are transverse to one another, second, straight U-shape, edgewise, complementary tenon and mortise joints are further provided edgewisely of those corner blocks for frictional interlocking. Thus, no separate pin, bent units or the like are required to anchor the corner portions of the three-dimensional structure. The self-standing, enclosing structure is continuous, and show a continuous image on its external face.

Known in the art, there is also U.S. Pat. No. 5,445,380 granted to Polsky in which is described a rectangular multi-picture folding puzzle that serves for the amusement of its user. The folding puzzle is composed of a flat base sheet material with a patchwork of partial picture images printed on at least one playing side and additionally subdivided into at least sixteen equal and uniform squares by a combination of score lines and cuts which enable the player to fold square segments into proper juxtaposition to assemble a complete individual picture image.

Also known to the Applicant are the following U.S. Pat. Nos. and industrial designs which describe different puzzles: 4,993,989; 5,299,804; 5,826,873; 6,015,150; 6,024,360; Des. 246,544; and Des. 248,987.

A problem associated with the above-mentioned prior art is that it does not teach a two-dimensional jigsaw puzzle formed of separate pieces which is capable of being bent without any of its pieces detaching themselves from the puzzle.

SUMMARY OF THE INVENTION

An object of the present invention is to provide a two-dimensional jigsaw puzzle formed of separate pieces which is capable of being bent without any of its pieces detaching themselves from the puzzle.

In accordance with the invention, the above object is achieved by a two-dimensional jigsaw puzzle comprising a plurality of pieces, each of said pieces having a main body made of a foam with memory, each main body having a layer of glue extending thereover and a flexible sheet adhesively bonded thereto, the flexible sheet bearing a portion of a picture of the puzzle, the main bodies of the pieces having complementary interlocking joints for detachably assembling the pieces to one another to form the picture of the puzzle, each of the main bodies having a peripheral side surface with predetermined thickness such that, when the pieces are assembled to one another, the interlocking joints substantially hold the pieces together by friction contact between the peripheral side surfaces of the main bodies, the glue being of a type which remains substantially flexible after setting thereof.

The foam with memory is preferably polyethylene foam and the complementary interlocking joints preferably consist of dovetail joints.

Preferably also, the pieces of the puzzle are cut with no loss of material by die cutting and the glue is preferably hot melt adhesive pressure sensitive.

Also according to another aspect of the present invention, there is provided a method for producing a two-dimensional jigsaw puzzle, said method comprising the steps of:

a) providing a sheet of foam with memory, having a layer of glue extending thereover and a main flexible sheet adhesively bonded thereto, the main flexible sheet comprising a picture of the puzzle, the glue being of a type which remains substantially flexible after setting thereof; and b) die cutting with no loss of material said sheet of foam with memory into a plurality of pieces each having a main body, the main bodies of the pieces being cut so as to have complementary interlocking joints for detachably assembling the pieces to one another to form a picture of the puzzle, each of the main bodies having a peripheral side surface with predetermined thickness such that, when the pieces are assembled to one another, the interlocking joints substantially hold the pieces together by friction contact between the peripheral side surfaces of the main bodies.

The invention and its advantages will be better understood by reading the following non-restrictive description of preferred embodiments thereof, made with reference to the accompanying drawings.

DESCRIPTION OF THE PREFERRED EMBODIMENTS

In the following description, the same numerical references refer to similar elements. The embodiments shown in the figures are preferred.

Figure 1:
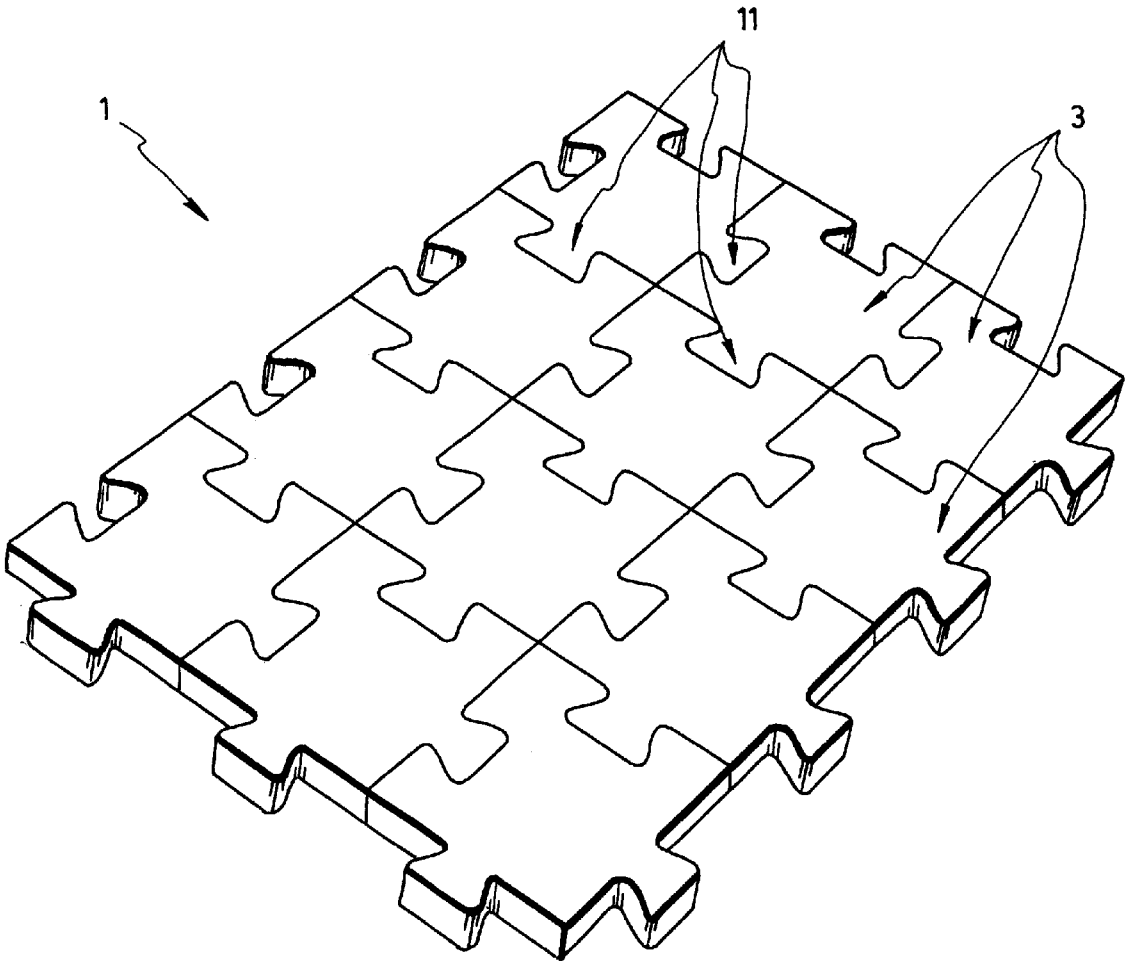
FIG. 1 is a perspective view of the puzzle according to a preferred embodiment of the invention.
Figure 2:
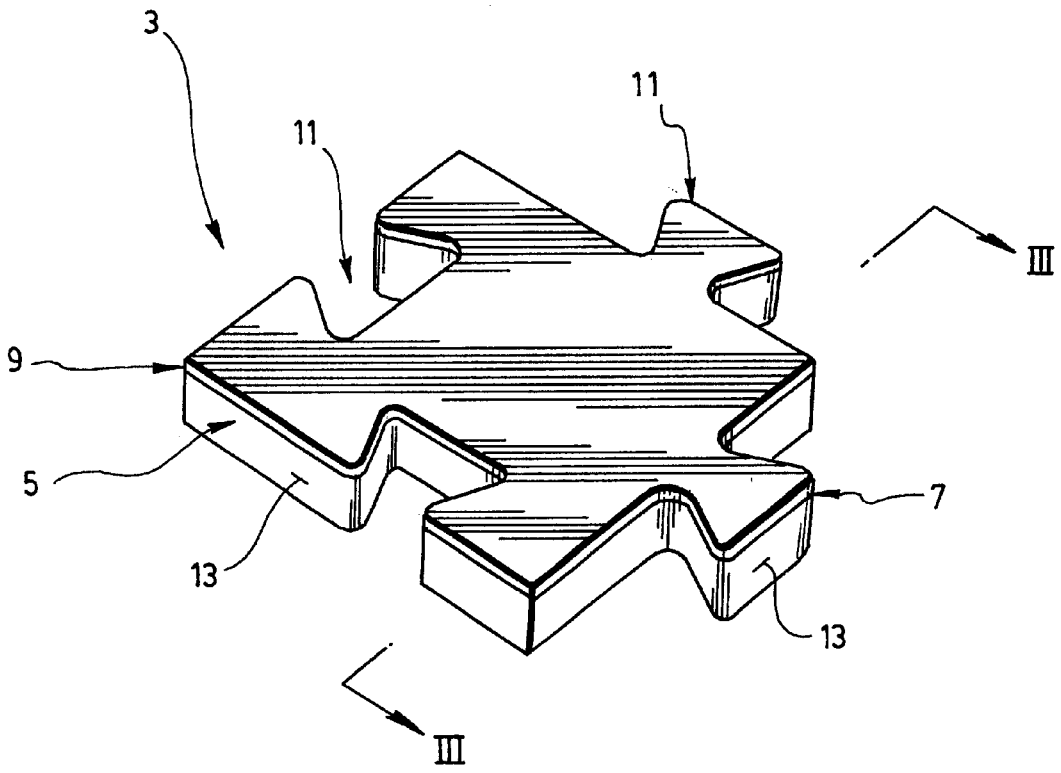
FIG. 2 is a perspective view of a piece according to a preferred embodiment of the invention of the puzzle shown in FIG. 1.
Figure 3:
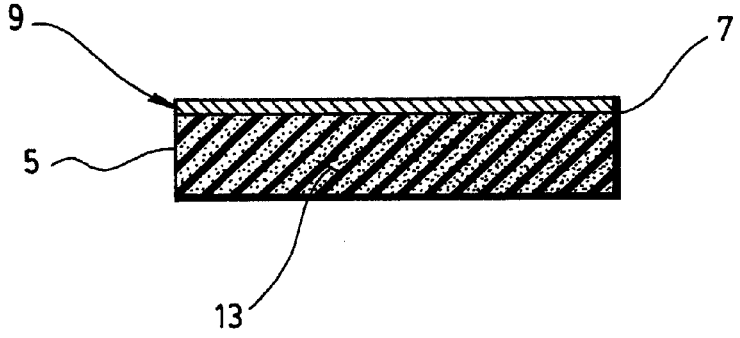
FIG. 3 is a cross-sectional view taken along line V—V of the piece shown in FIG. 2.

Referring now to FIGS. 1 to 3, one can see a perspective view of the puzzle 1 according to a preferred embodiment of the invention. The puzzle 1 is a two-dimensional jigsaw puzzle 1 comprising a plurality of pieces 3. Each piece 3 has a main body 5 made of a foam with memory. Each main body 5 has a layer of glue 7 extending thereover and a flexible sheet 9 adhesively bonded thereto. The flexible sheet 9 bears a portion of a picture of the puzzle and the main bodies 5 of the pieces 3 have complementary interlocking joints 11 for detachably assembling the pieces 3 to one another to form the picture of the puzzle 1. Each of the main bodies 5 has a peripheral side surface 13 with predetermined thickness such that, when the pieces 3 are assembled to one another, the interlocking joints 11 substantially hold the pieces 3 together by friction contact between the peripheral side surfaces 13 of the main bodies 5. The glue 7 is of a type which remains substantially flexible after setting thereof.

Preferably, the predetermined thickness is of at least 3/32 of an inch.

The foam with memory is preferably polyethylene foam and the complementary interlocking joints 11 preferably consist of dovetail joints.

Preferably also, the pieces 3 of the puzzle 1 are cut with no loss of material by die cutting and the glue 7 is preferably hot melt adhesive pressure sensitive.

Preferably also, the predetermined thickness is at least 3 mm, the glue 7 is preferably non-toxic and the flexible sheet 9 is preferably a laminated sheet of paper.

According to another aspect of the present invention, the method for producing the above-discussed two-dimensional jigsaw puzzle 1 comprises the steps of:

a) providing a sheet of foam with memory, having a layer of glue 7 extending thereover and a main flexible sheet 9 adhesively bonded thereto, the main flexible sheet comprising a picture of the puzzle 1, the glue 7 being of a type which remains substantially flexible after setting thereof; and b) die cutting with no loss of material said sheet of foam with memory into a plurality of pieces 3 each having a main body 5, the main bodies 5 of the pieces 3 being cut so as to have complementary interlocking joints 11 for detachably assembling the pieces 3 to one another to form a picture of the puzzle 1, each of the main bodies 5 having a peripheral side surface 13 with predetermined thickness such that, when the pieces 3 are assembled to one another, the interlocking joints 11 substantially hold the pieces 3 together by friction contact between the peripheral side surfaces 13 of the main bodies 5.

Preferably, in step (a), the foam with memory is polyethylene foam and the glue is hot melt adhesive pressure sensitive.

Preferably also, in step (b), the complementary interlocking joints 11 are dovetail joints.

Preferably also, in step (a), the sheet of foam has a predetermined thickness of at least 3 mm and the main flexible sheet is a laminated sheet of paper.

As better shown in FIG. 1, the puzzle 1 according to the present invention resembles conventional two-dimensional jigsaw puzzles when it is laid down onto a flat surface.

Figure 4:
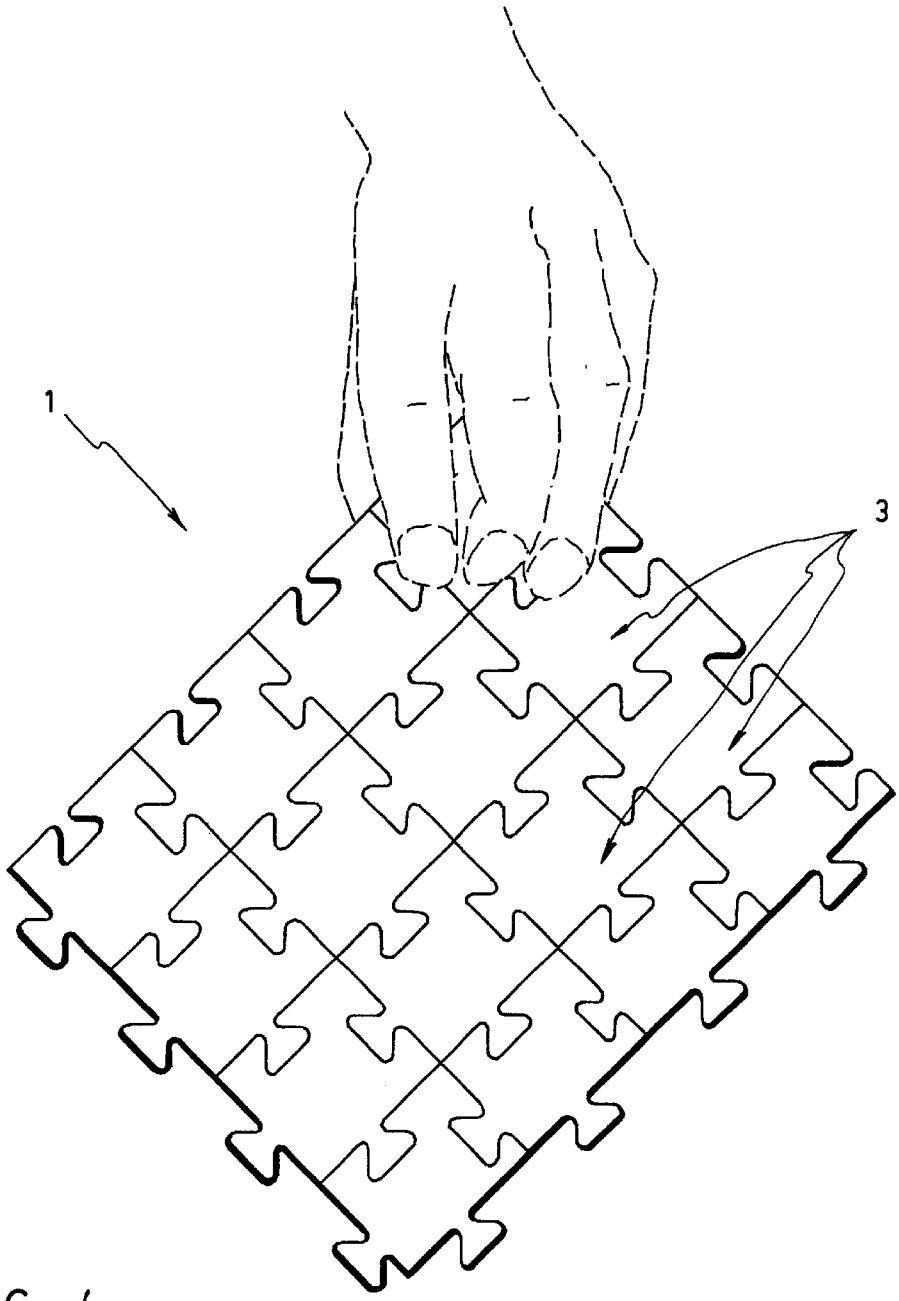
FIG. 4 is a schematic side elevational top view of the hand of a user holding the puzzle shown in FIG. 1.

However, unlike the jigsaw puzzles known in the art and as better shown in FIG. 4, the jigsaw puzzle 1 according to the present invention may be transported without any of its pieces 3 detaching themselves from the puzzle 1, i.e. the puzzle 1 may substantially sustains its own weight without collapsing. This is primarily due to the design of the individual pieces 3, as explained herein, and their cooperation thereinbetween, by means, for example, of the peripheral side surfaces 13, the interlocking joints 11 and the foam with memory constituting the main bodies 5 of the pieces 3, as well as the flexible sheets 9 adhesively bonded thereover, as better shown in FIGS. 2 and 3.

Figure 5:
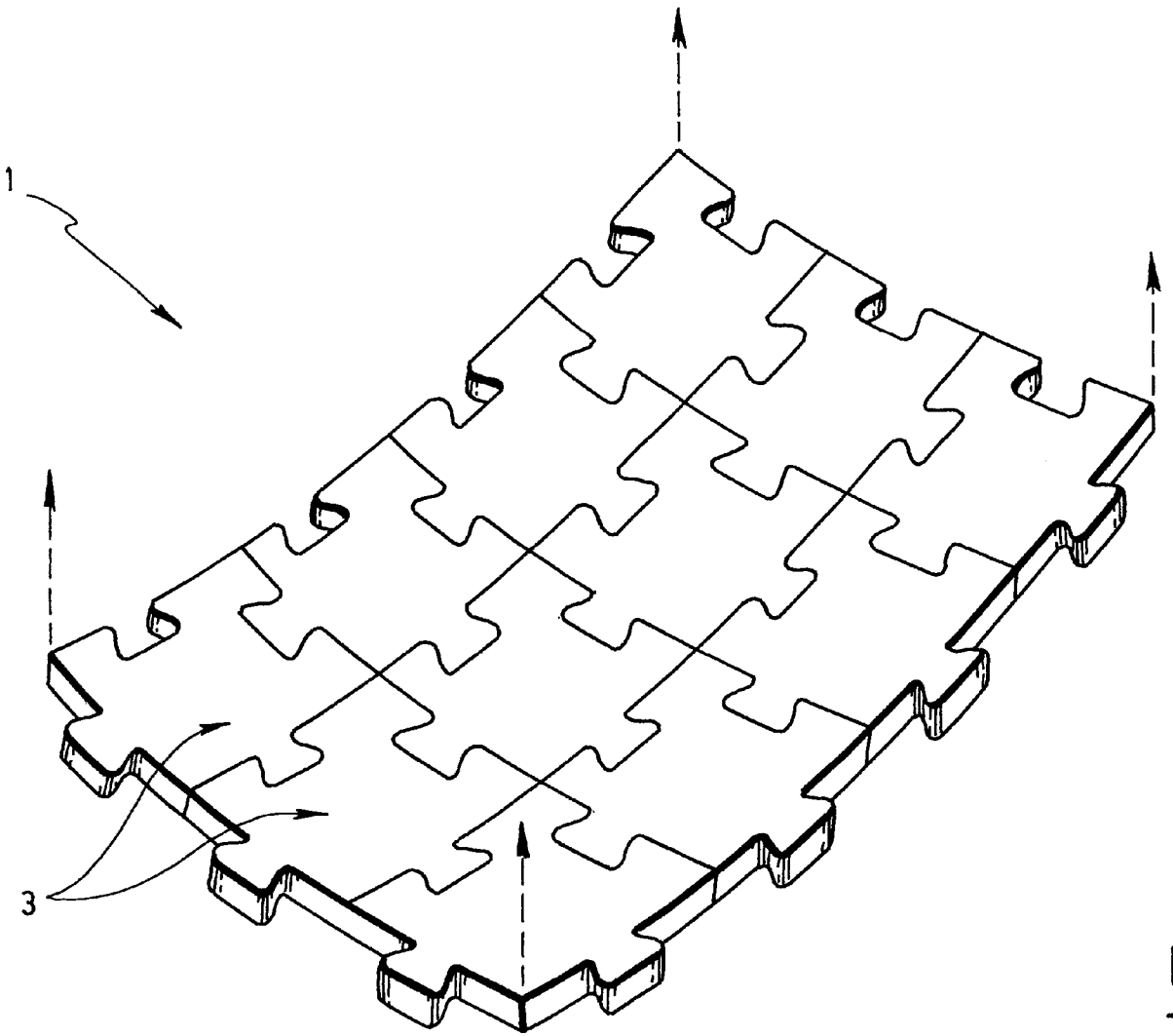
FIG. 5 is a perspective view of the puzzle shown in FIG. 1, said puzzle being shown in a bent manner.
Figure 6:
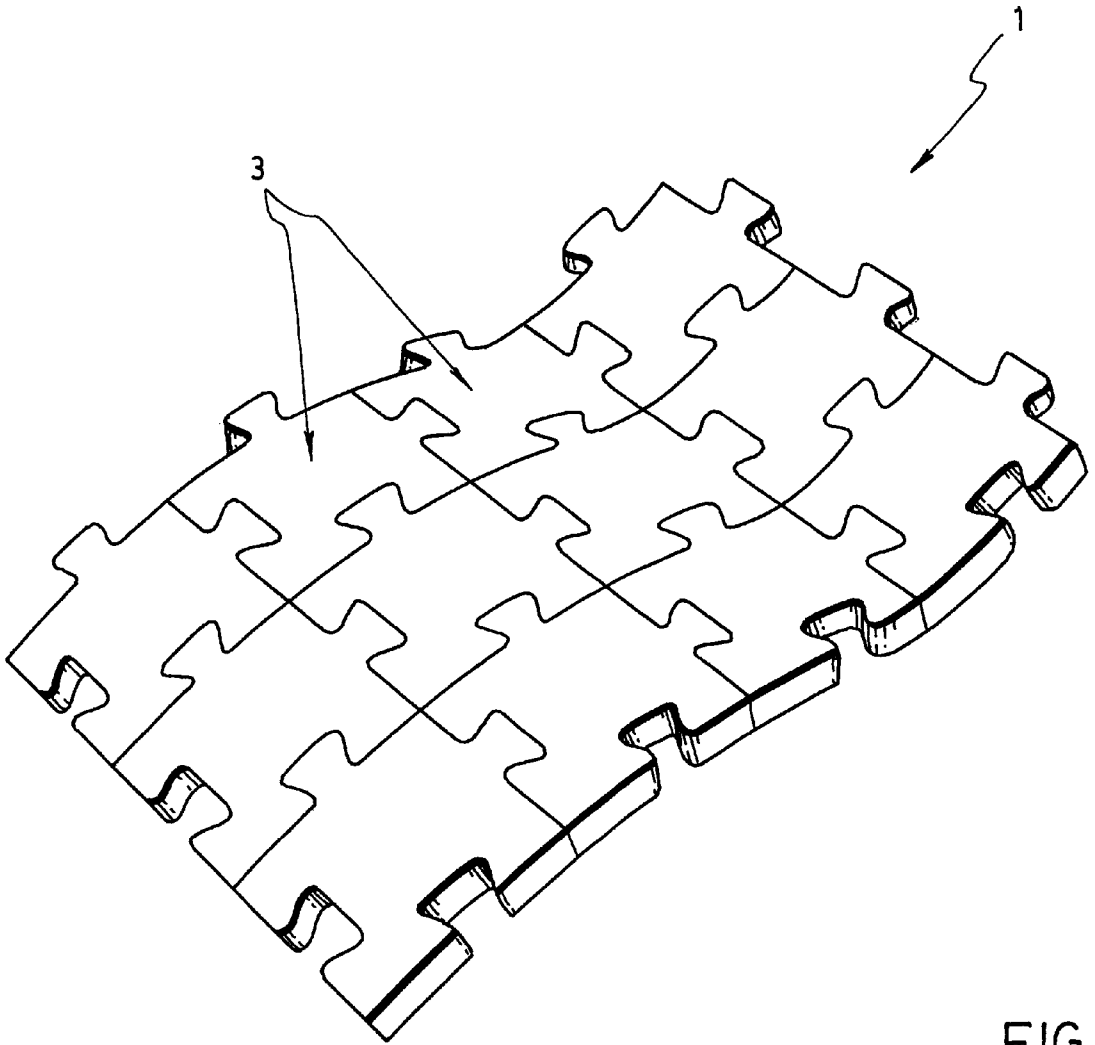
FIG. 6 is a perspective view of the puzzle shown in FIG. 1, said puzzle being shown being shaken.

Similarly, as better shown in FIGS. 5 and 6, the puzzle 1 according to the present invention, due to its conception as explained herein, may also be substantially "bent" in various manners without any of its pieces 3 detaching themselves from the puzzle 1. It is to be understood that the expression "bent" should not be taken in its restrictive sense, i.e. should not be taken as to limit the scope of the present invention, and may include many other non-coplanar movements and states which may be reasonably imposed onto the puzzle 1 without any of its pieces 3 detaching themselves therefrom, such as being "curved", "twisted", "warped", "shaken", "vibrated", etc., as apparent to a person skilled in the art. Furthermore, the above-mentioned expressions may be used interchangeably in the context of the present invention, as also apparent to a person skilled in the art.

Preferably, the factors involved in enabling the above-mentioned effects, as illustrated for example in FIGS. 4 to 6, are the following: the mechanical properties of the glue used to bond the flexible sheets onto the main bodies; the thickness of the main bodies, i.e. the peripheral side surfaces thereof; and the mechanical properties of the material used for the main bodies 5, i.e. the foam with memory.

As aforementioned and as better shown in FIGS. 2 and 3, each main body 5 preferably consists of a sheet of polyethylene foam or any other foam structure with memory, that is, capable of returning to a previous shape after being cut. The sheets of polyethylene foam or any other foam structure with memory, used to make the main bodies 5 of the pieces 3, are preferably cut with no loss of material, preferably by die cutting, in order to achieve a perfect fit, so as to obtain preferably full friction among the pieces 3 when they are assembled onto one another, so that they can hold themselves together. As a result of the above-mentioned, a very clear puzzle picture may be achieved. Preferably also, the thickness of each main body 5 is at least 3 mm and the flexible sheet 9 is preferably a laminated sheet of paper adhesively bonded to the main body 5 by means of a glue 7, which does not dry completely, and which does not harden so as to prevent cracking. This glue 7 is preferably a hot melt adhesive pressure sensitive and non-toxic.

It should be understood that other types of material may be used for the main bodies 5, as well as for the flexible sheets 9, as apparent to a person skilled in the art. Foams are a preferred embodiment of the main body 5 because they are light, porous, semi-rigid, and/or spongy, with a low density imposing to the piece 3 a reduced weight so that the assembled puzzle 1 can sustain its own weight while being able to be bent in various manners, resulting from the properties and dimensions of the material being used for the main body 5 and for the flexible sheet 9 of each piece 3, as explained hereinabove and as illustrated in FIGS. 4 to 6.

The puzzle 1, the material being used for the main bodies, and the dimensions thereof, are devised so that once the puzzle 1 is assembled, it can hold itself together so that it can be easily transported and can even be substantially curved or shaken, without any of its pieces 3 detaching themselves from the main puzzle body.

The thickness and the friction of the material used for the main bodies are selected so that the resulting puzzle 1 of given dimensions can sustain its own weight by means of the friction among the assembled pieces 3 and so that these pieces 3 can hold themselves together even when the puzzle 1 is being reasonably curved or bent, as apparent to a person skilled in the art.

As may now be appreciated, the puzzle 1 according to the present invention is a substantial improvement over the prior art in that, as explained hereinabove, it is capable of being reasonably bent without any of its pieces 3 detaching themselves from the puzzle 1, something which was not possible with the two-dimensional jigsaw puzzles known in the art.

Of course, numerous modifications could be made to the above-described embodiments without departing from the scope of the invention as defined in the appended claims.

What is claimed is:

1. A two-dimensional jigsaw puzzle comprising a plurality of pieces, each of said pieces having a main body made of a foam with memory, each main body having a layer of glue extending thereover and a flexible sheet adhesively bonded thereto, the flexible sheet bearing a portion of a picture of the puzzle, the main bodies of the pieces having complementary interlocking joints for detachably assembling the pieces to one another to form the picture of the puzzle, each of the main bodies having a peripheral side surface with predetermined thickness such that, when the pieces are assembled to one another, the interlocking joints substantially hold the pieces together by friction contact between the peripheral side surfaces of the main bodies, the glue being of a type which remains substantially flexible after setting thereof.

2. A two-dimensional jigsaw puzzle according to claim 1, wherein the foam with memory is polyethylene foam.

3. A two-dimensional jigsaw puzzle according to claim 1, wherein the complementary interlocking joints consist of dovetail joints.

4. A two-dimensional jigsaw puzzle according to claim 1, wherein the predetermined thickness is at least 3 mm.

5. A two-dimensional jigsaw puzzle according to claim 1, wherein the pieces of the puzzle are cut with no loss of material by die cutting.

6. A two-dimensional jigsaw puzzle according to claim 1, wherein the glue is hot melt adhesive pressure sensitive.

7. A two-dimensional jigsaw puzzle according to claim 1, wherein the glue is non-toxic.

8. A two-dimensional jigsaw puzzle according to claim 1, wherein the flexible sheet is a laminated sheet of paper.

9. A two-dimensional jigsaw puzzle comprising a plurality of pieces, each of said pieces having a main body made of a foam with memory, each main body having a layer of glue extending thereover and a flexible sheet adhesively bonded thereto, the flexible sheet bearing a portion of a picture of the puzzle, the main bodies of the pieces having complementary interlocking joints for detachably assembling the pieces to one another to form the picture of the puzzle, each of the main bodies having a peripheral side surface with predetermined thickness such that, when the pieces are assembled to one another, the interlocking joints substantially hold the pieces together by friction contact between the peripheral side surfaces of the main bodies, the glue being of a type which remains substantially flexible after setting thereof, the foam with memory being polyethylene foam, the complementary interlocking joints consisting of dovetail joints, the predetermined thickness being at least 3 mm, the pieces of the puzzle being cut with no loss of material by die cutting, and the glue being hot melt adhesive pressure sensitive.

10. A method for producing a two-dimensional jigsaw puzzle, said method comprising the steps of:

a) providing a sheet of foam with memory, having a layer of glue extending thereover and a main flexible sheet adhesively bonded thereto, the main flexible sheet comprising a picture of the puzzle, the glue being of a type which remains substantially flexible after setting thereof; and b) die cutting with no loss of material said sheet of foam with memory into a plurality of pieces each having a main body, the main bodies of the pieces being cut so as to have complementary interlocking joints for detachably assembling the pieces to one another to form a picture of the puzzle, each of the main bodies having a peripheral side surface with predetermined thickness such that, when the pieces are assembled to one another, the interlocking joints substantially hold the pieces together by friction contact between the peripheral side surfaces of the main bodies.

11. A method according to claim 10, wherein, in step (a), the foam with memory is polyethylene foam.

12. A method according to claim 10, wherein, in step (b), the complementary interlocking joints are dovetail joints.

13. A method according to claim 10, wherein, in step (a), the sheet of foam has a predetermined thickness of at least 3 mm.

14. A method according to claim 10, wherein, in step (a), the glue is hot melt adhesive pressure sensitive.

15. A method according to claim 10, wherein, in step (a), the main flexible sheet is a laminated sheet of paper.

* * * * *